US007375703B2

(12) United States Patent
Jeong

(10) Patent No.: US 7,375,703 B2
(45) Date of Patent: May 20, 2008

(54) DRIVING DEVICE AND METHOD FOR PLASMA DISPLAY PANEL

(75) Inventor: Jin-Hee Jeong, Ahsan (KR)

(73) Assignee: Samsung SDI Co., Ltd., Suwon (KR)

( * ) Notice: Subject to any disclaimer, the term of this patent is extended or adjusted under 35 U.S.C. 154(b) by 785 days.

(21) Appl. No.: 10/714,658

(22) Filed: Nov. 18, 2003

(65) Prior Publication Data

US 2004/0104869 A1 Jun. 3, 2004

(30) Foreign Application Priority Data

Nov. 28, 2002 (KR) ..... 10-2002-0074658

(51) Int. Cl.
*G09G 3/28* (2006.01)

(52) U.S. Cl. ..... 345/60; 315/169.4

(58) Field of Classification Search ..... 345/60–68, 345/204

See application file for complete search history.

(56) References Cited

U.S. PATENT DOCUMENTS 6,249,087 B1 * 6/2001 Takayama et al. ..... 315/169.1

FOREIGN PATENT DOCUMENTS

JP 2000-305510 11/2000

* cited by examiner

*Primary Examiner*—Duc Q Dinh
(74) *Attorney, Agent, or Firm*—H.C. Park & Associates, PLC

(57) ABSTRACT

Disclosed is a PDP driving method. During the reset period, a bias voltage of a sustain electrode below a first bias voltage is applied during a peak maintain period after a Y ramp falling period, or a discharge stabilization stage for lowering a relative potential of a scan electrode is provided before the Y ramp starts falling, thereby improving address features, stably obtaining voltage margins, providing advantages for low gray and low temperatures according to stable obtainment of the voltage margins, and reducing the light in the reset period to improve the contrast.

12 Claims, 6 Drawing Sheets

DRIVING DEVICE AND METHOD FOR PLASMA DISPLAY PANEL

CROSS REFERENCE TO RELATED APPLICATION

This application is based on Korea Patent Application No. 2002-74658 filed on Nov. 28, 2002 in the Korean Intellectual Property Office, the content of which is incorporated herein by reference in its entirety.

BACKGROUND OF THE INVENTION (a) Field of the Invention

The present invention relates to a PDP (plasma display panel) driving method. More specifically, the present invention relates to a PDP driving method for stabilizing the sustain discharge.

(b) Description of the Related Art

A PDP is a flat display for displaying characters and images using plasma generated by gas discharge, and from several tens to several millions of pixels are provided in a matrix format on the PDP depending on the size of the pixels. A PDP may be classified as a direct current (DC) PDP or an alternating current (AC) PDP depending upon the patterns of the applied driving voltage waveforms and the structures of the discharge cells.

Electrodes of DC PDPs are exposed in the discharge space, and hence the current flows in the discharge space while the voltage is applied. Thus, a resistor must be provided for current restriction to solve this problem. Electrodes of AC PDPs are covered with a dielectric layer, and therefore the current is restricted because of formation of a natural capacitance component, and since the electrodes are protected from ion shocks at the discharge time, AC PDPs generally have a longer lifespan than DC PDPs.

FIG. 1 shows a partial perspective view of an AC PDP. As shown, pairs of scan electrodes 4 and sustain electrodes 5, which are covered with a dielectric layer 2 and a protection film 3, are provided in parallel below a first glass substrate 1. A plurality of address electrodes 8, which are covered with an insulation layer 7, are installed on a second glass substrate 6. Barrier ribs 9, which are parallel to the address electrodes 8, are formed on the insulation layer 7. Phosphor 10 is formed on the surface of the insulation layer 7 and on both sides of the barrier ribs 9.

The first glass substrate 1 and the second glass substrate 6 are provided facing each other with discharge areas 11 between them so the scan electrodes 4 and the sustain electrodes 5 may cross the address electrodes 8. The discharge area provided at crossing nodes of the address electrodes 8 and the pairs of the scan electrode 4 and the sustain electrode 5 form discharge cells 12.

FIG. 2 shows a PDP electrode arrangement diagram. As shown, the PDP electrode has an m×n matrix configuration, and in detail, address electrodes A1 through Am are arranged in the row direction, and n scan electrodes Y1 through Yn and n sustain electrodes X1 through Xn are alternately arranged in the column direction. The scan electrodes will be referred to as "Y electrodes," and the sustain electrodes as "X electrodes" hereinafter. The discharge cell 12 of FIG. 2 corresponds to the discharge cell of FIG. 1.

FIG. 3 shows a conventional PDP driving waveform diagram. As shown, each subfield following a conventional PDP driving method comprises a reset period, an address period, and a sustain period. Eight to twelve subfields of the above-noted PDP form a single frame, and realize a single image.

During the reset period, a wall charge state of a previous sustain discharge is erased, and the wall charges are set up to stably perform the next addressing.

During the address period, cells to be turned on are selected to accumulate wall charges on the cells to be turned on (i.e., addressed cells). During the sustain period, a discharge is performed to display the actual images on the addressed cells.

FIGS. 4(*a*) through 4(*d*) show the wall charges distributed to the electrodes at the respective (a), (b), (c), and (d) periods of FIG. 3.

Referring to FIGS. 4(*a*) through 4(*d*), the operation of the conventional reset period will be described in detail. The reset period includes an erase period, a Y ramp rising period, and a Y ramp falling period.

(1) Erase Period

When the final sustain is finished, positive charges are accumulated to the X electrode, and negative charges are accumulated to the Y electrode, as shown in FIG. 4(*a*). The address voltage is maintained at 0V (volts) during the sustain period, however, because it tries to maintain a middle voltage of the sustain all the time, a relatively large amount of the positive charges are accumulated to the address electrodes.

When the sustain is finished, an erase ramp voltage that gradually increases from 0(V) to +Ve(V) is applied to the X electrode, and the wall charges formed on the X and Y electrodes are gradually erased, as shown in FIG. 4(*b*).

(2) Y Ramp Rising Period

During this period, the address electrode and the X electrode are maintained at 0V, and a ramp voltage is applied to the Y electrode, the ramp voltage gradually rising from the voltage Vs, which is below the discharge firing voltage with respect to the X electrode, to the voltage Vset, which is greater than the discharge firing voltage. While the ramp voltage rises, first weak resetting discharge is generated in all the discharge cells from the Y electrode to the address electrode and the X electrode. As a result, the negative wall charges are accumulated to the Y electrode, and concurrently, the positive wall charges are accumulated to the address electrode and the X electrode, as shown in FIG. 4(*c*).

(3) Y Ramp Falling Period

In the latter part of the reset period, a ramp voltage that gradually falls from the voltage Vs, which is below the discharge firing voltage, to 0(V) is applied to the Y electrode while the X electrode maintains a constant voltage Ve. While the ramp voltage falls, a second weak resetting discharge is generated in all the discharge cells because the potential difference between the X electrode and the Y electrode exceeds the discharge firing voltage. As a result, the negative wall charges of the Y electrode are reduced, and the polarity of the X electrode is inverted to accumulate weak negative charges thereto, as shown in FIG. 4(*d*). Also, the positive wall charges of the address electrode are adjusted to an appropriate value for the address operation. In this instance, when the reset operation is ideally performed, a voltage difference corresponding to the discharge firing voltage Vf is always maintained within the discharge cell as shown in Equation 1.

$$V_{f,xy}=V_e+V_{w,xy}$$

$$V_{f,ay}=V_{w,ay} \qquad \text{Equation 1}$$

where Vf,xy is a discharge firing voltage between the X and Y electrodes, Vf,ay is a discharge firing voltage between the address and Y electrodes, Vw,xy is a voltage caused by the wall charges accumulated to the X and Y electrodes, Vw,ay is a voltage caused by the wall charges accumulated to the address and Y electrodes, and Ve is an externally applied voltage between the X and Y electrodes.

As given by Equation 1, the discharge firing voltage can be maintained with a small amount of wall charge since the voltage Ve (substantially 200V) is supplied between the X and Y electrodes. However, the address electrodes and the Y electrodes are to maintain the discharge firing voltage using the wall charges since no external voltage is supplied to the address electrodes and the Y electrodes.

However, the charges shown in FIG. 4(*d*) with circles around them on the X and Y electrodes do not function to maintain the voltage difference between the X and Y electrodes. Nevertheless, these charges are accumulated because the discharge firing voltage between the address electrode and Y electrode is achieved using only the wall charges between the address and Y electrodes after accumulating a large amount of positive charges to the address electrode and a large amount of negative charges to the Y electrode.

FIG. 5 shows a detailed conventional waveform and a distribution of wall charges during the Y ramp falling period. The distribution diagram of the wall charges shown on the right of FIG. 5 shows a distribution of wall charges at the time (d). As shown, the X bias voltage Vx1 is easily discharged because it forms a relatively large potential difference. Further, since the background brightness increases, the entire contrast reduces. Also, the relative large X bias potential heavily erases the wall charges after the Y ramp rising, thereby generating unstable subsequent addressing.

FIG. 6 shows another conventional waveform and a distribution of wall charges in the Y ramp falling period.

As known from the waveform on the left of FIG. 6, an X bias voltage Vx2 which is relatively lower than the X bias voltage of FIG. 5 is applied to the sustain electrode.

In this case, however, discharge may be delayed since the potential between the Y electrode and the X electrode is low during the Y ramp falling period, and over-discharge is likely to occur because the large amount of the wall charges accumulated during the Y ramp rising period are not sufficiently erased.

SUMMARY OF THE INVENTION

This invention provides a PDP driving method for preventing a heavy reduction of wall charges after the completion of resetting, thereby improving addressing characteristics and improving the contrast.

This invention separately provides a method for driving a PDP which prevents discharge delay and over-discharge caused by a low potential between a scan electrode and a sustain electrode.

In one aspect of the present invention, a method for driving a PDP including a scan electrode and a sustain electrode provided in parallel on a first substrate, and an address electrode provided on a second substrate and crossing the scan electrode and the sustain electrode, comprises: during a reset period, applying a rising ramp voltage to the sustain electrode up to a first voltage level (Ve), and erasing wall charges, when previous sustaining is finished, maintaining the address electrode and the sustain electrode at 0 V(volts) when the erasing is finished, and applying a ramp voltage to the scan electrode, the ramp voltage gradually rising to a voltage (Vset) over a discharge firing voltage (Vf) from a voltage (Vs) below the discharge firing voltage with respect to the sustain electrode, applying a ramp voltage to the scan electrode while maintaining the sustain electrode at the first bias voltage Ve, when the stop of maintaining the address electrode is finished, the ramp voltage gradually falling to a predetermined voltage from Vs with respect to the sustain electrode; and maintaining the sustain electrode at a second bias voltage below the first bias voltage of the sustain electrode during the predetermined voltage maintain period of the scan electrode formed after finishing the stop of applying a ramp voltage.

The level of the second bias voltage of the sustain electrode is substantially identical to the voltage level of Vs.

In another aspect of the present invention, a PDP driver comprises a plasma panel for providing a plurality of address electrodes, and first electrodes and the second electrodes crossing the address electrodes, the first electrodes and the second electrodes being in pairs and in parallel, and the crossing area of the address electrodes and the first electrodes and the second electrodes forming a discharge cell. A controller for externally receiving video signals, and generating an address driving signal and first electrode driving signals and the second electrode driving signals. The apparatus includes an address driver for receiving the address driving signal from the controller, and applying a display data signal for selecting a discharge cell to be displayed to the address electrode. A first driver receives the driving signals from the controller and applies a voltage to a first electrode of a cell selected for discharge so as to generate discharge to the first electrode; and a second driver for receiving the driving signals from the controller, and applying a voltage to the second electrode so that the cell selected for discharge may maintain discharging for a predetermined time. The first driver applies a voltage that is ramp-risen to a first voltage level to the first electrode, maintains the voltage at a second voltage level below the first voltage level, ramp-falls the voltage to a third voltage level, and maintains the ramp-fallen voltage, and the second driver applies a first bias voltage to the second electrode during the ramp falling period of the first electrode, and applies a second bias voltage below the first bias voltage to the second electrode while the first electrode is maintained at a third voltage level.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE EXEMPLARY EMBODIMENTS

In the following detailed description, only exemplary embodiments of the invention have been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Driving waveforms according to the exemplary embodiment of the present invention are generated in consideration of relative voltage differences between an address electrode and an X electrode, and an X electrode and a Y electrode.

Figure 7:
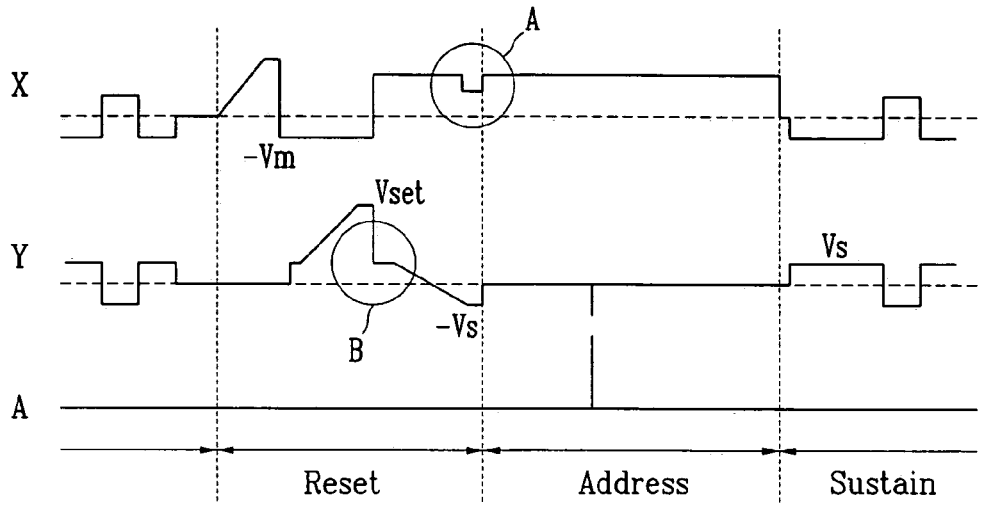
FIG. 7 shows a PDP driving waveform according to an exemplary embodiment of the present invention.

FIG. 7 shows a PDP driving waveform according to an exemplary embodiment of the present invention. As shown, the reset period of the PDP driving method according to an exemplary embodiment of this invention includes an erase stage, a Y ramp rising stage, a Y ramp falling stage, and a discharge stabilization stage.

In the erase stage, an erase ramp voltage gradually rising from 0(V) to +Ve(V) is applied to the X electrode after a previous sustain period is finished, and hence the wall charges formed in the X and Y electrodes are gradually erased.

In the Y ramp rising stage, the address electrodes are maintained at 0V, and a ramp voltage gradually rising from the voltage Vs, which is below the discharge firing voltage Vf, to the voltage Vset, which is over the discharge firing voltage with respect to the X electrode, is applied to the Y electrode. As shown in FIG. 7 during the Y ramp rising stage, the voltage of the X electrode is maintained at −Vm. The voltage −Vm may be greater than or equal to −Vs, and may be a reference voltage.

Accordingly, a first weak resetting discharge is generated in all the discharge cells from the Y electrode to the address electrodes and the X electrodes while the ramp voltage rises. As a result, the negative wall charges are accumulated to the Y electrode, and concurrently, the positive wall charges are accumulated to the address electrodes and the X electrodes.

After this, as shown in part B of FIG. 7, when the relative potential is lowered during the period when the wall charges are erased before the Y ramp falling stage, discharge is delayed, and a smaller amount of negative wall charges is erased from the X electrode.

During the Y ramp falling stage, a ramp voltage gradually falling from Vs(V) to 0V or −Vs(V) with respect to the X electrode is applied to the Y electrode while the X electrode maintains Ve(V).

A second weak resetting discharge is generated in all the discharge cells while the ramp voltage falls, and as a result, the negative wall charges of the Y electrode reduce, and the polarity of the X electrode is inverted to accumulate weak negative charges. Also, the positive wall charges of the address electrode are adjusted to an appropriate value for the address operation.

As shown in part A of FIG. 7, during the discharge stabilization stage, the bias voltage of the X electrode is reduced from Ve(V) to Vx3 during the peak maintain period of the Y electrode at which the wall charges are formed.

Figure 1:
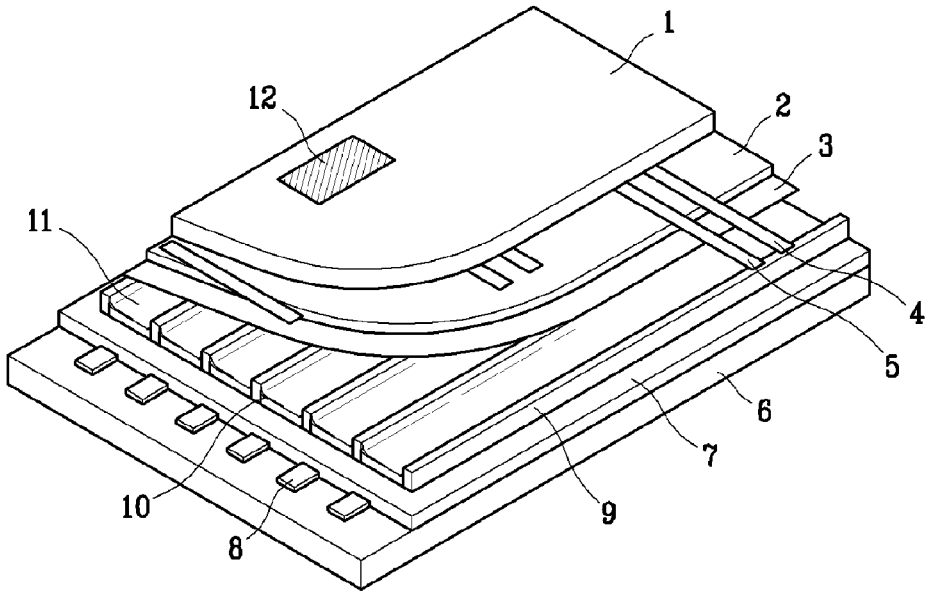
FIG.1(Prior Art)
FIG. 1 shows a partial perspective view of an AC PDP.
Figure 2:
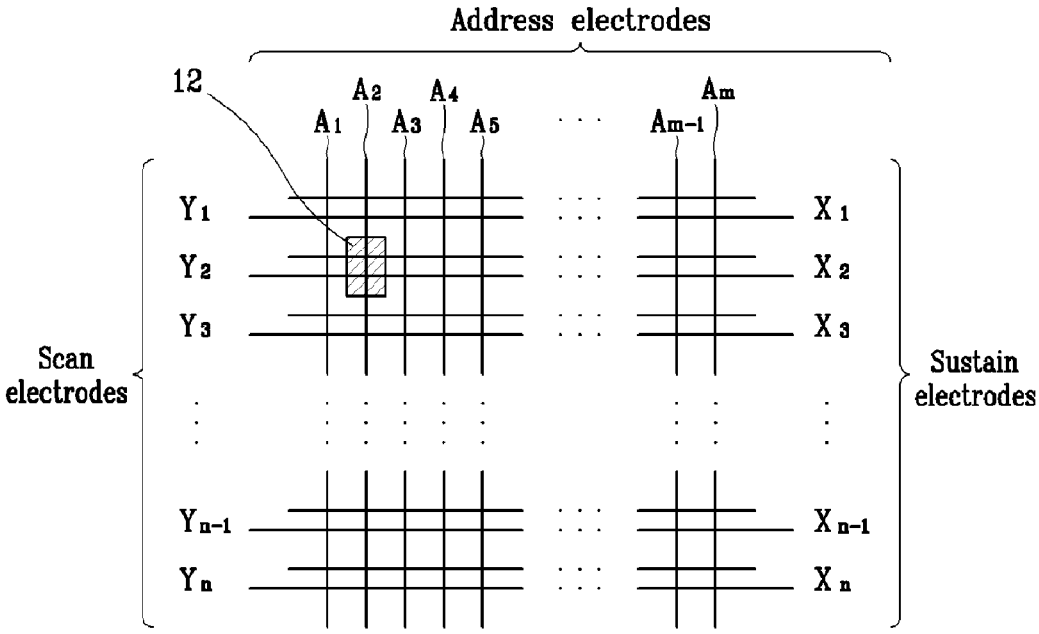
FIG.2(Prior Art)
FIG. 2 shows an electrode arrangement diagram of the PDP.
Figure 3:
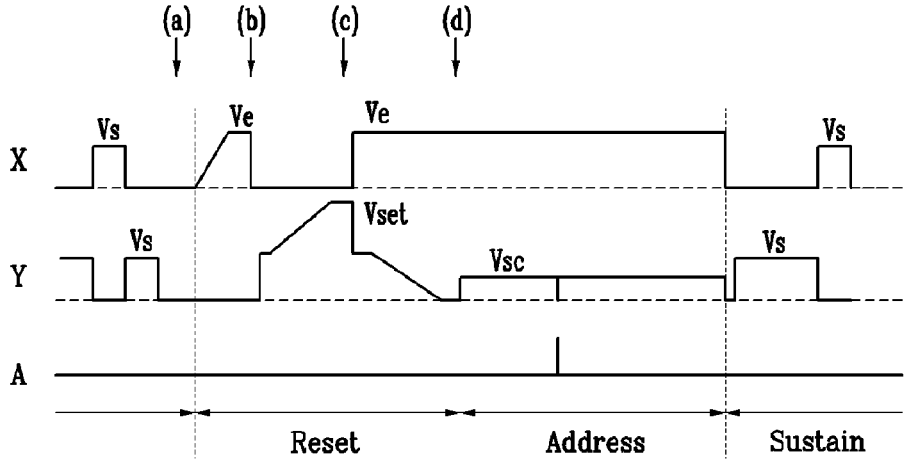
FIG.3(Prior Art)
FIG. 3 shows a driving waveform diagram of the conventional PDP.
Figure 4A:
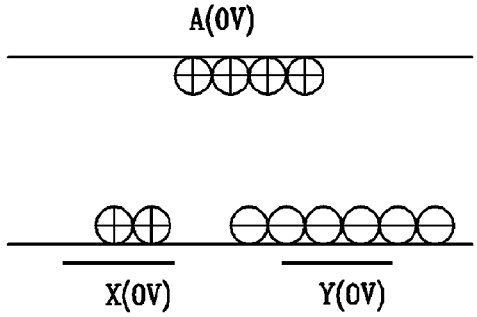
FIG.4A(Prior Art)
FIG. 4A, FIG. 4B, FIG. 4C, and FIG. 4D each show a distribution diagram of wall charges for the steps in the driving waveform of FIG. 3.
Figure 4B:
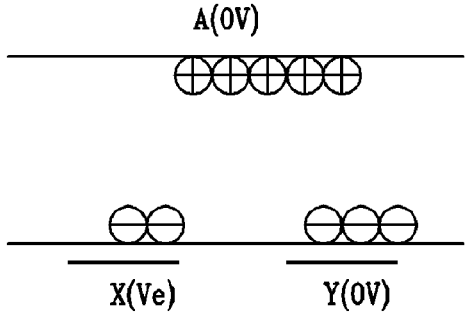
FIG.4B(Prior Art)
Figure 4C:
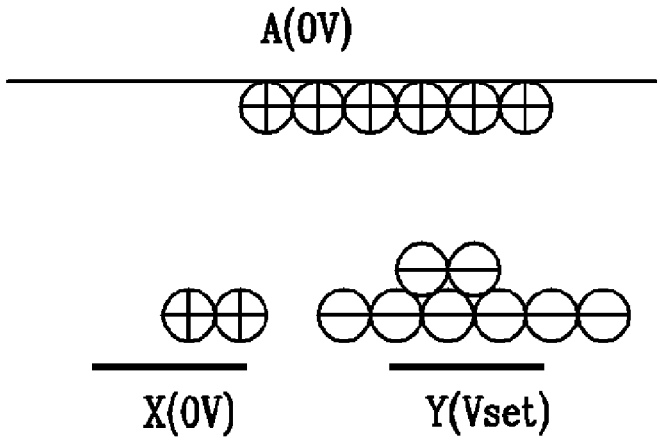
FIG.4C(Prior Art)
Figure 4D:
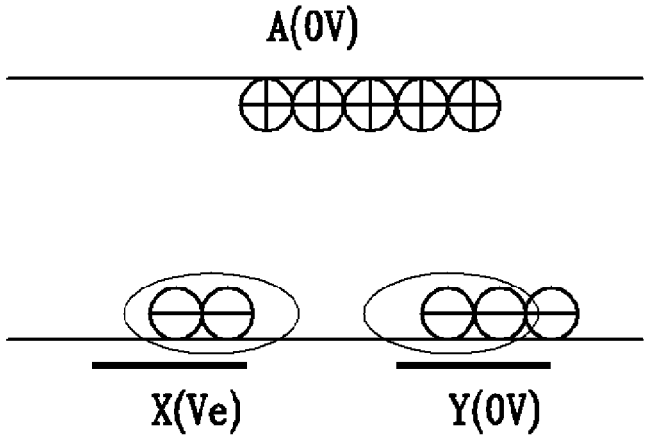
FIG.4D(Prior Art)
Figure 5:
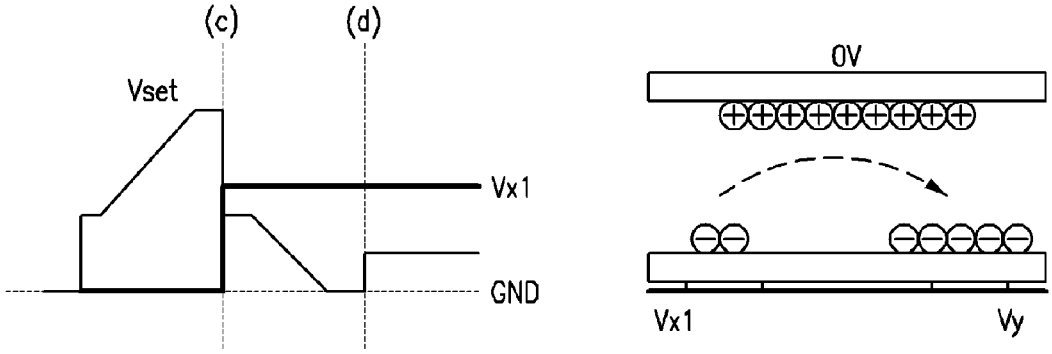
FIG.5(Prior Art)
FIG. 5 shows a conventional waveform diagram and a charge distribution diagram.
Figure 6:
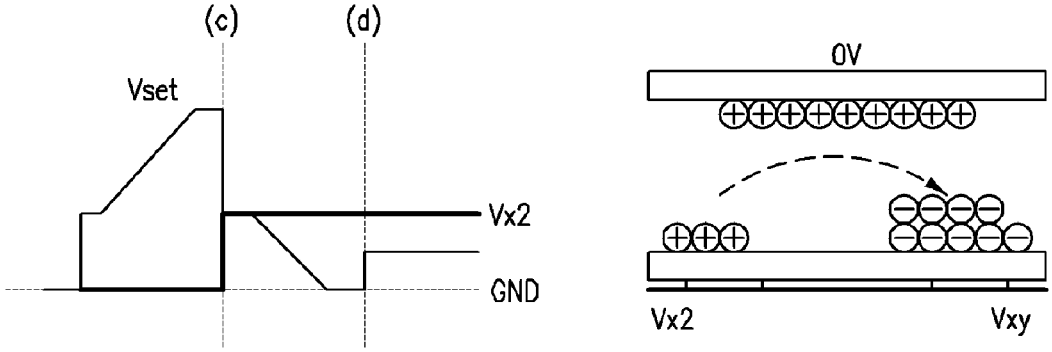
FIG.6(Prior Art)
FIG. 6 shows another conventional waveform diagram and a charge distribution diagram.
Figure 8:
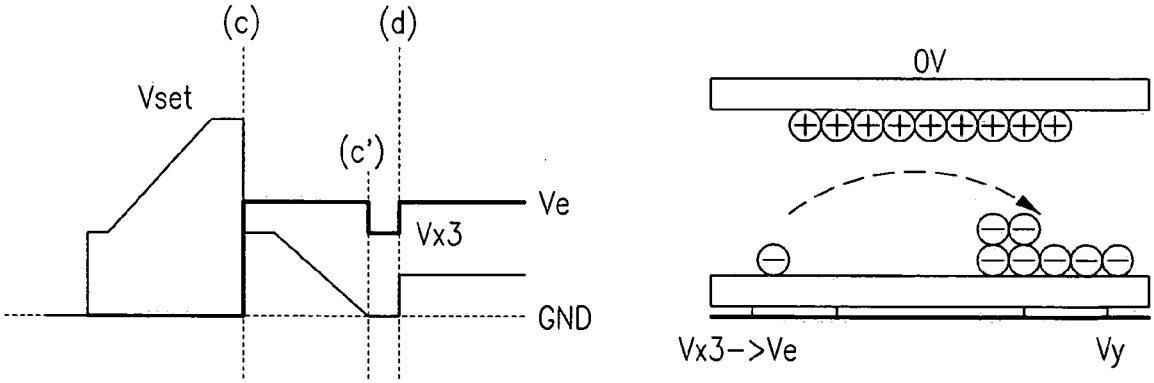
FIG. 8 shows a driving waveform diagram and a charge distribution diagram according to an exemplary embodiment of the present invention.

FIG. 8 shows a driving waveform diagram and a charge distribution diagram according to an exemplary embodiment of the present invention. The times (c) and (d) of FIG. 8 respectively correspond to (c) and (d) of FIGS. 5 and 6. As shown in FIG. 8, after the Y electrode reaches a predetermined voltage, the bias voltage of the X electrode is maintained at Vx3, which is below the bias voltage Ve, while the Y electrode maintains the predetermined voltage obtained after the falling ramp (i.e., from (c') to (d)).

Therefore, the potential difference between the Y electrode and the X electrode can be appropriately maintained such that it is not too high and not too low. Also, since a smaller number of wall charges are erased as compared to the amount of wall charges in the method disclosed in the prior art of FIG. 5, the embodiment is more advantageous for the subsequent addressing. Also, since more wall charges are erased as compared to the amount of wall charges in the method disclosed in the prior art of FIG. 6, over-discharge can be prevented.

Because the X and Y potentials are uniformly maintained in the period from (c') to (d), above-described advantages can be obtained by selecting an appropriate voltage level Vx3 based on the amount of the wall charges erased during the Y ramp falling period.

In another way, the voltage at the Y falling ramp is maintained to be greater than or equal to −Vs in the reset period, and the negative bias voltage −Vm at the X electrode is set to be greater than or equal to −Vs during the Y rising ramp period, thereby adjusting the amount of the accumulated wall charges.

The amount of wall charges being erased can therefore be adjusted by setting the Y electrode voltage to be −Vs below 0V after the Y falling ramp, and maintaining the voltage. That is, by adjusting the voltage level at the time when the potential of the X electrode or the Y electrode is uniformly maintained in order to adjust the amount of the wall charges, the bias voltage of the X electrode can be adjusted in the above-noted discharge stabilization stage so that an unstable operation may not be generated because of the very large variation in the quantity of the bias voltage.

Figure 9:
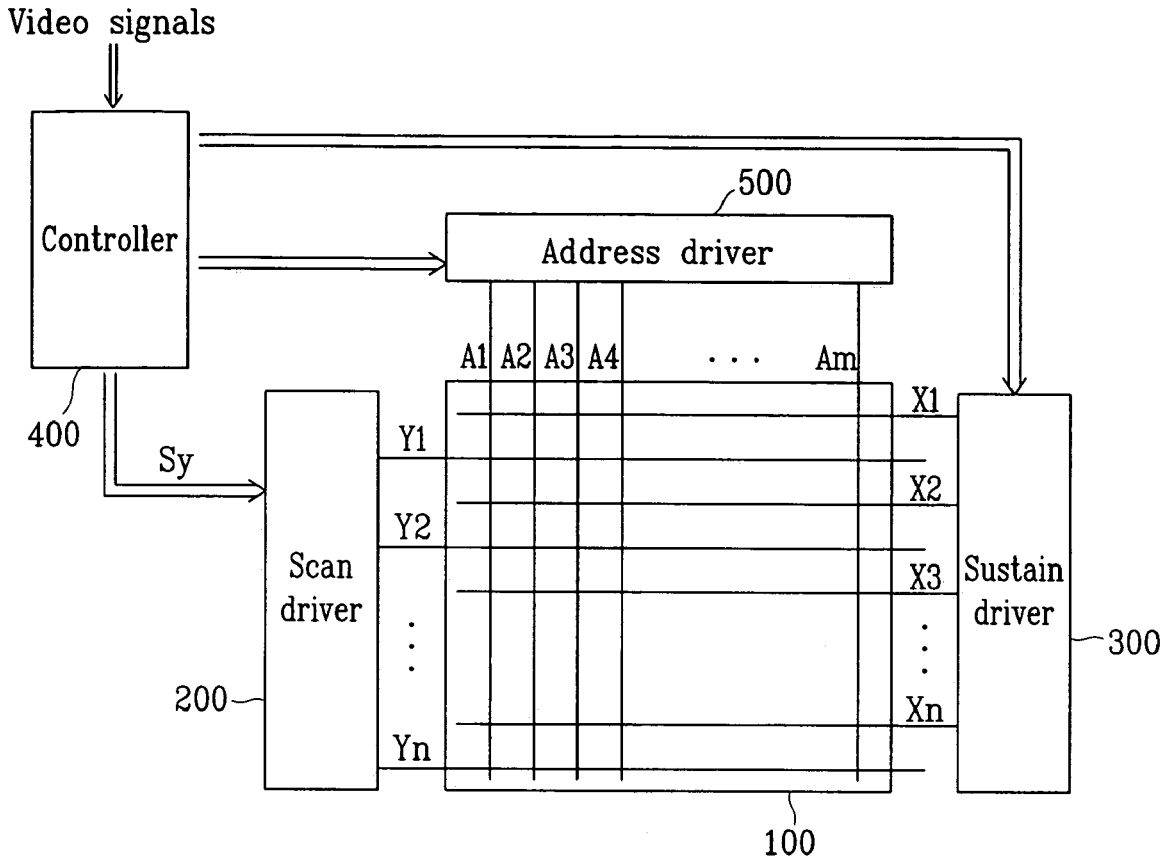
FIG. 9 shows a PDP driver according to an exemplary embodiment of the present invention.

FIG. 9 shows a PDP driver according to an exemplary embodiment of the present invention. As shown, the PDP comprises a plasma panel 100, a controller 400, a scan driver 200, a sustain driver 300, and an address driver 500. The plasma panel 100 includes a plurality of address electrodes A1 through Am arranged in the column direction, and scan electrodes Y1 through Yn and sustain electrodes X1 through Xn alternately arranged in the row direction.

The controller 400 receives external video signals, generates an address driving signal $S_A$, a scan electrode signal $S_Y$, and a sustain electrode signal $S_X$, and transmits them to the address driver 500, the scan driver 200, and the sustain driver 300, respectively. The address driver 500 receives the address driving signal $S_A$ from the controller 400, and applies display data signals for selecting discharge cells to be displayed to the respective electrodes.

The scan driver 200 and the sustain driver 300 receive the scan electrode signal $S_Y$ and the sustain electrode signal $S_X$ from the controller 400, and alternately input a sustain voltage to the scan electrode and the sustain electrode to thereby perform sustaining in the selected discharge cells.

As described above, the sustain driver 300 lowers the X bias voltage by a predetermined voltage from Ve to Vx3 during the discharge stabilization stage in order to control the erased amount of the wall charges.

The PDP driving method according to the exemplary embodiment of the present invention improves addressing features because of the discharge stabilization stage which takes place after the reset period is finished, and obtains a voltage margin through the stabilized addressing. The PDP driving method also improves the contrast by reducing the discharge amount during the peak maintain period of the scan electrode.

That is, when the Y ramp falling stage is finished, the wall voltage (Vw)=the discharge firing voltage (Vf)−the bias voltage of sustain electrode+wall voltage in the Y ramp rising period.

In this instance, when the bias voltage of the sustain electrode is lowered to Vx3, which may be Vs, from Ve, the wall voltage increases, and addressing may be carried out better.

Also, since the potential between the sustain electrode and the scan electrode is low, the discharge delay and over-discharge can be prevented.

The PDP driving method according to this invention sets a discharge stabilization stage when the falling of the Y ramp falling period ends during the reset period, to improve addressing features and to obtain stable voltage margins.

Further, the PDP driving method is advantageous for low gray and low temperature with bad discharge conditions since the voltage margins are stably obtained, and the method reduces the light in the reset period, thereby improving the contrast.

While this invention has been described in connection with what is presently considered to be a practical exemplary embodiment, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel including a scan electrode and a sustain electrode provided in parallel on a first substrate, and an address electrode provided on a second substrate, the address electrode crossing the scan electrode and the sustain electrode, the method comprising:

during a reset period, applying a ramp voltage to the sustain electrode to a first voltage after a previous sustain period is complete;

maintaining the address electrode and the sustain electrode at a second voltage, and applying a rising ramp voltage to the scan electrode, the rising ramp voltage gradually rising from a third voltage to a fourth voltage, the third voltage being less than a discharge firing voltage with respect to the sustain electrode and the fourth voltage being greater than the discharge firing voltage;

applying a falling ramp voltage to the scan electrode while maintaining the sustain electrode at a first bias voltage, the falling ramp voltage gradually falling to a predetermined voltage from the third voltage; and maintaining the sustain electrode at a second bias voltage below the first bias voltage while maintaining the scan electrode at the predetermined voltage after the applying a falling ramp voltage.

2. The method of claim 1, wherein the second voltage is a reference voltage.

3. The method of claim 1, wherein the second bias voltage is substantially identical to the third voltage.

4. The method of claim 1, wherein the second voltage is a negative voltage.

5. The method of claim 1, wherein the predetermined voltage has an equal magnitude and opposite polarity to the third voltage.

6. A plasma display panel driver, comprising:

a plasma panel comprising a plurality of address electrodes, and first electrodes and second electrodes crossing the address electrodes, the first electrodes and the second electrodes being in pairs and parallel to each other, and a crossing area of the address electrode and the first electrodes and the second electrodes forming a discharge cell;

a controller for externally receiving video signals, and generating an address driving signal, first electrode driving signals and second electrode driving signals;

an address driver for receiving the address driving signal from the controller, and applying a display data signal for selecting a discharge cell to be displayed to the address electrode;

a first driver for receiving the first electrode driving signals from the controller, and applying a voltage to a first electrode of a discharge cell selected for discharge to generate discharge in the discharge cell; and a second driver for receiving the second electrode driving signals from the controller, and applying a voltage to a second electrode of the discharge cell selected for discharge so that the discharge cell selected for discharge maintains discharging for a predetermined time, wherein the first driver applies a voltage that is ramp-risen to a first voltage level to the first electrode, maintains the voltage at a second voltage level below the first voltage level, ramp-falls the voltage to a third voltage level, and maintains the voltage at the third voltage level, and wherein the second driver applies a first bias voltage to the second electrode while the voltage at the first electrode is ramp-fallen to the third voltage level, and applies a second bias voltage below the first bias voltage to the second electrode while the first electrode is maintained at the third voltage level.

7. The PDP driver of claim 6, wherein the voltage level of the second bias voltage is substantially identical to the second voltage level of the first electrode.

8. A method for driving a plasma display including a scan electrode and a sustain electrode provided in parallel on a first substrate, and an address electrode provided on a second substrate, the address electrode crossing the scan electrode and the sustain electrode, the method comprising:

during a reset period, applying a falling ramp voltage to the scan electrode and applying a first bias voltage to the sustain electrode; and applying a second bias voltage to the sustain electrode after applying the falling ramp voltage, the second bias voltage having a voltage level lower than a voltage level of the first bias voltage; and applying a predetermined voltage to the scan electrode after applying the falling ramp voltage, wherein the falling ramp voltage falls to the predetermined voltage.

9. The method of claim 1, wherein the first bias voltage is substantially identical to the first voltage.

10. The method of claim 1, wherein the predetermined voltage is a reference voltage.

11. The method of claim 1, wherein the predetermined voltage is a negative sustain voltage.

12. A method for driving a plasma display panel including a scan electrode and a sustain electrode provided in parallel on a first substrate, and an address electrode provided on a second substrate, the address electrode crossing the scan electrode and the sustain electrode, the method comprising:

during a reset period, applying a ramp voltage to the sustain electrode to a first voltage after a previous sustain period is complete;

maintaining the address electrode at a second voltage, maintaining the sustain electrode at a third voltage, and applying a rising ramp voltage to the scan electrode, the rising ramp voltage gradually rising from a fourth voltage to a fifth voltage, the fourth voltage being less than a discharge firing voltage with respect to the sustain electrode and the fifth voltage being greater than the discharge firing voltage;

applying a falling ramp voltage to the scan electrode while maintaining the sustain electrode at a first bias voltage, the falling ramp voltage gradually falling to a predetermined voltage from the fourth voltage; and maintaining the sustain electrode at a second bias voltage below the first bias voltage while maintaining the scan electrode at the predetermined voltage after the applying a falling ramp voltage.

* * * * *